US008511593B2

(12) United States Patent
Romanovich

(10) Patent No.: US 8,511,593 B2
(45) Date of Patent: Aug. 20, 2013

(54) DIFFERENTIAL JAM PROOF SENSOR FOR A SHREDDER

(75) Inventor: Dmitry Romanovich, Wheaton, IL (US)

(73) Assignee: Fellowes, Inc., Itasca, IL (US)

( * ) Notice: Subject to any disclaimer, the term of this patent is extended or adjusted under 35 U.S.C. 154(b) by 492 days.

(21) Appl. No.: 12/790,517

(22) Filed: May 28, 2010

(65) Prior Publication Data

US 2011/0290924 A1 Dec. 1, 2011

(51) Int. Cl.
*B02C 4/32* (2006.01)
*B02C 7/14* (2006.01)

(52) U.S. Cl.
USPC ..... 241/36; 241/236; 241/100; 241/101.3

(58) Field of Classification Search
USPC ..... 241/33, 36, 236, 100, 101.3
See application file for complete search history.

(56) References Cited

U.S. PATENT DOCUMENTS

| | | | |
|---|---|---|---|
| 2,221,516 | A | 11/1940 | Hathaway |
| 3,619,537 | A | 11/1971 | Hosokawa et al. |
| 3,724,766 | A | 4/1973 | Bosland |
| 3,764,819 | A | 10/1973 | Muller |
| 3,785,230 | A | 1/1974 | Lokey |
| 3,829,850 | A | 8/1974 | Guetersloh |
| 3,947,734 | A | 3/1976 | Fyler |
| 4,192,467 | A | 3/1980 | Hatanaka |
| 4,352,980 | A | 10/1982 | Hibari |
| 4,378,717 | A | 4/1983 | Schneider et al. |
| 4,489,897 | A | 12/1984 | Turner |
| 4,495,456 | A | 1/1985 | Vercillo et al. |
| 4,497,478 | A | 2/1985 | Reschenhofer |
| 4,683,381 | A | 7/1987 | Dufoug |
| 4,707,704 | A | 11/1987 | Allen |
| 4,757,949 | A | 7/1988 | Horton |
| 4,814,632 | A | 3/1989 | Glaeser |

(Continued)

FOREIGN PATENT DOCUMENTS

| | | |
|---|---|---|
| DE | 3313232 | 10/1984 |
| DE | 8619856.4 | 10/1988 |

(Continued)

OTHER PUBLICATIONS

Complaint for Declaratory Judgment filed on Nov. 15, 2010 by Royal Applicance Manufacturing Co., d/b/a/ TTI Floor Care North America and Techtronic Industries Co. Ltd. against Fellowes, Inc.

(Continued)

*Primary Examiner* — Bena Miller
(74) *Attorney, Agent, or Firm* — Pillsbury Winthrop Shaw Pittman LLP

(57) ABSTRACT

Disclosed is a shredder including a detector having a first contact member on one side of the shredder's throat and a second contact member on the other side. The contact members extend into the throat and are independently moveable relative to one another to enable insertion of an article into the throat. The article can move the contact members relative to one another by a combined amount. The shredder may prevent its motor from driving its cutter elements if it determines that the combined amount of independent relative movement correlates to a thickness that is equal to or greater than a predetermined maximum thickness. In an embodiment, the contact members may include binary switches. The contact members aid in controlling and/or reducing flutter and wrinkles when articles are fed into the shredder.

19 Claims, 9 Drawing Sheets

(56) References Cited

U.S. PATENT DOCUMENTS

| | | | |
|---|---|---|---|
| 4,815,669 | A | 3/1989 | Fujii |
| 4,842,205 | A | 6/1989 | Araki |
| 4,889,291 | A | 12/1989 | Goldhammer et al. |
| 4,890,797 | A | 1/1990 | Fujii et al. |
| 4,914,721 | A | 4/1990 | Glaeser |
| 5,017,972 | A | 5/1991 | Daughton |
| 5,081,406 | A | 1/1992 | Hughes et al. |
| 5,139,205 | A | 8/1992 | Gallagher et al. |
| 5,166,679 | A | 11/1992 | Vranish et al. |
| 5,167,374 | A | 12/1992 | Strohmeyer |
| 5,186,398 | A | 2/1993 | Vigneau, Jr. |
| 5,198,777 | A | 3/1993 | Masuda et al. |
| 5,342,033 | A | 8/1994 | Iwata |
| 5,345,138 | A | 9/1994 | Mukaidono et al. |
| 5,353,468 | A | 10/1994 | Yap |
| 5,397,890 | A | 3/1995 | Schueler et al. |
| 5,409,171 | A | 4/1995 | Stangenberg et al. |
| 5,415,355 | A | 5/1995 | Gollwitzer |
| 5,429,313 | A | 7/1995 | Schwelling |
| 5,453,644 | A | 9/1995 | Yap |
| 5,494,229 | A | 2/1996 | Rokos |
| 5,539,322 | A | 7/1996 | Zoughi et al. |
| 5,662,280 | A | 9/1997 | Nishio et al. |
| 5,743,521 | A | 4/1998 | Munakata et al. |
| 5,772,129 | A | 6/1998 | Nishio et al. |
| 5,775,605 | A | 7/1998 | Tsai |
| 5,823,529 | A | 10/1998 | Mandel |
| 5,850,342 | A | 12/1998 | Nakamura et al. |
| 5,871,162 | A | 2/1999 | Rajewski |
| 5,924,637 | A | 7/1999 | Niederholtmeyer |
| D412,716 | S | 8/1999 | Kroger |
| 5,942,975 | A | 8/1999 | Sorensen |
| D414,198 | S | 9/1999 | Iwata |
| 5,988,542 | A | 11/1999 | Henreckson |
| 6,065,696 | A | 5/2000 | Tsai |
| D426,805 | S | 6/2000 | Iwata |
| 6,079,645 | A | 6/2000 | Henreckson |
| 6,116,528 | A | 9/2000 | Schwelling |
| 6,141,883 | A | 11/2000 | Mitchell et al. |
| 6,265,682 | B1 | 7/2001 | Lee |
| 6,376,939 | B1 | 4/2002 | Suzuki et al. |
| 6,418,004 | B1 | 7/2002 | Mather et al. |
| 6,550,701 | B1 | 4/2003 | Chang |
| 6,561,444 | B1 | 5/2003 | Yokomine et al. |
| 6,601,787 | B1 | 8/2003 | Langenecker |
| 6,655,943 | B1 | 12/2003 | Peterson |
| 6,666,959 | B2 | 12/2003 | Uzoh et al. |
| 6,676,460 | B1 | 1/2004 | Motsenbocker |
| 6,698,640 | B2 | 3/2004 | Hakozaki |
| 6,724,324 | B1 | 4/2004 | Lambert |
| 6,802,465 | B1 | 10/2004 | Norcott et al. |
| 6,979,813 | B2 | 12/2005 | Avril |
| 6,983,903 | B2 | 1/2006 | Chang |
| 6,997,408 | B2 | 2/2006 | Watano |
| 7,025,293 | B2 | 4/2006 | Matlin et al. |
| 7,040,559 | B2 | 5/2006 | Matlin |
| 7,166,561 | B2 | 1/2007 | Allen |
| 7,210,867 | B1 | 5/2007 | Silverbrook |
| 7,213,780 | B2 | 5/2007 | Chen |
| 7,311,276 | B2 | 12/2007 | Matlin et al. |
| 7,490,786 | B2 | 2/2009 | Matlin et al. |
| 7,520,452 | B2 | 4/2009 | Watano et al. |
| 7,584,545 | B2 | 9/2009 | Pan et al. |
| 7,624,938 | B2 | 12/2009 | Aries et al. |
| 7,631,822 | B2 | 12/2009 | Matlin et al. |
| 7,631,823 | B2 | 12/2009 | Matlin et al. |
| 7,631,824 | B2 | 12/2009 | Matlin et al. |
| 7,635,102 | B2 | 12/2009 | Matlin et al. |
| 7,661,614 | B2 | 2/2010 | Matlin et al. |
| 7,663,769 | B2 | 2/2010 | Hayashihara et al. |
| 7,712,689 | B2 | 5/2010 | Matlin et al. |
| 2003/0016365 | A1 | 1/2003 | Liess et al. |
| 2003/0042342 | A1 | 3/2003 | Kroger et al. |
| 2004/0008122 | A1 | 1/2004 | Michael |
| 2004/0069883 | A1 | 4/2004 | Watanabe et al. |
| 2004/0159198 | A1 | 8/2004 | Peot et al. |
| 2004/0194594 | A1 | 10/2004 | Dils et al. |
| 2004/0226800 | A1 | 11/2004 | Pierga |
| 2005/0046651 | A1 | 3/2005 | Askren et al. |
| 2005/0150986 | A1 | 7/2005 | Castronovo |
| 2005/0213106 | A1 | 9/2005 | Weijers et al. |
| 2006/0016919 | A1 | 1/2006 | Castronovo |
| 2006/0054725 | A1 | 3/2006 | Matlin et al. |
| 2006/0091247 | A1 | 5/2006 | Matlin |
| 2006/0219827 | A1 | 10/2006 | Matlin et al. |
| 2006/0243631 | A1 | 11/2006 | Duke |
| 2007/0007373 | A1 | 1/2007 | Matlin |
| 2007/0025239 | A1 | 2/2007 | Jain et al. |
| 2007/0063082 | A1 | 3/2007 | Coleman |
| 2007/0080252 | A1 | 4/2007 | Pierce |
| 2007/0087942 | A1 | 4/2007 | Allen |
| 2007/0164135 | A1 | 7/2007 | Zhong |
| 2007/0164138 | A1 | 7/2007 | Allen |
| 2007/0215728 | A1 | 9/2007 | Priester |
| 2007/0221767 | A1 | 9/2007 | Matlin et al. |
| 2007/0246582 | A1 | 10/2007 | Aries et al. |
| 2008/0093487 | A1 | 4/2008 | Lee |
| 2008/0231261 | A1 | 9/2008 | Dengler et al. |
| 2009/0025239 | A1 | 1/2009 | Pan |
| 2009/0032629 | A1 | 2/2009 | Aries et al. |
| 2009/0090797 | A1 | 4/2009 | Matlin et al. |
| 2010/0051731 | A1 | 3/2010 | Matlin et al. |
| 2010/0084496 | A1 | 4/2010 | Matlin et al. |
| 2010/0102153 | A1 | 4/2010 | Matlin et al. |
| 2010/0134805 | A1 | 6/2010 | Pan |
| 2010/0170967 | A1 | 7/2010 | Jensen et al. |
| 2010/0170969 | A1 | 7/2010 | Jensen et al. |
| 2010/0176227 | A1 | 7/2010 | Davis et al. |
| 2010/0181398 | A1 | 7/2010 | Davis et al. |
| 2010/0213296 | A1 | 8/2010 | Sued et al. |
| 2010/0213297 | A1 | 8/2010 | Sued et al. |
| 2010/0213300 | A1 | 8/2010 | Matlin et al. |
| 2010/0243774 | A1 | 9/2010 | Hu et al. |
| 2010/0252661 | A1 | 10/2010 | Matlin et al. |
| 2010/0252664 | A1 | 10/2010 | Matlin et al. |
| 2010/0270404 | A1 | 10/2010 | Chen |
| 2010/0282879 | A1 | 11/2010 | Chen |
| 2010/0288861 | A1 | 11/2010 | Cai et al. |
| 2010/0320297 | A1 | 12/2010 | Matlin et al. |
| 2010/0320299 | A1 | 12/2010 | Matlin et al. |
| 2011/0272504 | A1 | 11/2011 | Matlin et al. |
| 2011/0272505 | A1 | 11/2011 | Matlin et al. |
| 2011/0280642 | A1 | 11/2011 | Ikeda et al. |
| 2011/0297766 | A1* | 12/2011 | Chen ..... 241/33 |
| 2011/0297769 | A1 | 12/2011 | Matlin et al. |
| 2011/0297770 | A1 | 12/2011 | Matlin et al. |

FOREIGN PATENT DOCUMENTS

| | | |
|---|---|---|
| DE | 4121330 | 1/1993 |
| DE | 4207292 | 1/1993 |
| DE | 4237861 | 5/1994 |
| DE | 4437348 | 4/1996 |
| DE | 19835093 | 2/1999 |
| DE | 202004000907 | 5/2005 |
| DE | 102006036136 | 1/2008 |
| DE | 202010001577 U1 | 11/2010 |
| EP | 268244 | 11/1987 |
| EP | 0392867 | 10/1990 |
| EP | 562076 | 9/1992 |
| EP | 524708 | 1/1997 |
| EP | 0792691 | 9/1997 |
| EP | 0818241 | 1/1998 |
| EP | 856945 | 1/1998 |
| EP | 855221 | 7/1998 |
| EP | 1177832 | 2/2002 |
| EP | 1195202 | 4/2002 |
| EP | 2180290 | 7/2008 |
| EP | 2022566 | 2/2009 |
| GB | 1199903 | 7/1970 |
| GB | 2171029 | 8/1986 |
| GB | 2209963 | 6/1989 |
| GB | 2440651 | 2/2008 |
| GB | 2442942 | 4/2008 |
| GB | 2451513 | 2/2009 |

| | | |
|---|---|---|
| JP | 52-11691 | 1/1977 |
| JP | 5311911 | 3/1978 |
| JP | 57-76734 | 2/1982 |
| JP | 57-070445 | 4/1982 |
| JP | 57-070445 (U) | 4/1982 |
| JP | 58-223448 | 12/1983 |
| JP | 59150554 | 8/1984 |
| JP | 61-000702 | 1/1986 |
| JP | 62183555 | 11/1987 |
| JP | 63-173342 | 11/1988 |
| JP | 2-277560 | 11/1990 |
| JP | H2-303550 | 12/1990 |
| JP | 04-157093 | 5/1992 |
| JP | 04-0180852 | 6/1992 |
| JP | 5-96198 | 4/1993 |
| JP | H05-092144 | 4/1993 |
| JP | 6-277548 | 10/1994 |
| JP | 7-299377 | 11/1995 |
| JP | 8-108088 | 4/1996 |
| JP | 8-131861 | 5/1996 |
| JP | 08-131962 | 5/1996 |
| JP | 08-164343 | 6/1996 |
| JP | 9-38513 | 2/1997 |
| JP | 09075763 | 3/1997 |
| JP | 09-150069 | 10/1997 |
| JP | 9-262491 | 10/1997 |
| JP | 10-048344 | 2/1998 |
| JP | 11-216383 | 8/1999 |
| JP | 11-304942 | 11/1999 |
| JP | 2000346288 | 12/2000 |
| JP | 2002-239405 | 8/2002 |
| JP | 2004-321840 | 11/2004 |
| JP | 2004321993 | 11/2004 |
| WO | 2005070553 | 8/2005 |
| WO | 2006019985 | 2/2006 |
| WO | 2006036370 | 4/2006 |
| WO | 2007109753 | 9/2007 |
| WO | 2007122364 | 11/2007 |
| WO | 2007137761 | 12/2007 |

OTHER PUBLICATIONS

ACCO REXEL, Mainstream 1050/2150/2250/3150/3250 and 3350, 115V Machines Illustrated Parts Lists and Services Instructions, Mar. 25, 2002, Issue No. 4.

ACCO REXEL, Deckside and Office 115V Machines Illustrated Parts Lists and Service Instructions, Aug. 18, 1999.

ACCO REXEL, Deckside and Office 230V Machines Illustrated Parts Lists and Service Instructions, Aug. 1, 2000.

English Translation of Japanese Patent Application Publication No. 9-38513, published on Feb. 10, 1997.

U.S. Appl. No. 60/613,750, filed Sep. 27, 2004, Pierce.

U.S. Appl. No. 60/686,490, filed May 31, 2005, Pierce.

U.S. Appl. No. 60/688,285, filed Jun. 7, 2005, Pierce.

GBC Shredmaster Service Manual, Part #6001054, referencing Models 2230S and 2250X Paper Shredders, Nov. 1997.

The Stationary and Business Machines - Japan, "Ds-4000 by Carl Jimuki K.K.", Jun. 2003.

The Stationary and Business Machines - Japan, "Nse-501 Cn by Nakabayashi K.K.", Oct. 2004.

* cited by examiner

"third-class" lever
0.1mm = 1 sheet of 75gsm paper

DIFFERENTIAL JAM PROOF SENSOR FOR A SHREDDER

BACKGROUND OF THE INVENTION

1. Field of Invention

The present invention relates to shredders for destroying articles, such as documents, CDs, etc.

2. Description of Related Art

Shredders are well known devices for destroying substrate articles, such as documents, CDs, floppy disks, etc. Typically, users purchase shredders to destroy sensitive articles, such as credit card statements with account information, documents containing company trade secrets, etc.

A common type of shredder has a shredder mechanism contained within a housing that is removably mounted atop a container. The shredder mechanism typically has a series of cutter elements that shred articles fed therein and discharge the shredded articles downwardly into the container. The shredder typically has a stated capacity, such as a number of sheets of paper (typically of 20 lb. weight) that may be shredded at one time; however, the feed throat of a typical shredder can receive more sheets of paper than the stated capacity. A common frustration of users of shredders includes feeding too many papers into the feed throat, only to have the shredder jam after it has started to shred the papers. To free the shredder of the papers, the user typically reverses the direction of rotation of the cutter elements via a switch until the papers become free. Occasionally, the jam may be so severe that reversing may not free the paper entirely, and the paper must be pulled out manually, which may be difficult with the paper bound between blades of the cutter elements.

The assignee of this application, Fellowes, Inc., has developed thickness sensing technologies for shredders. By sensing thickness of paper or articles being fed into the shredder, the shredder can be stopped (or not started) before a severe jam occurs. U.S. Patent Application Publication Nos. 2006/0054725 A1 (U.S. Pat. No. 7,661,614) , 2006/0219827 A1 (U.S. Pat. No. 7,631,822), 2009/0090797 A1, and 2007/00221767 A1 disclose, among other things, a detector that can determine if an overly thick object is being inserted in a shredder throat. See also, U.S. patent application Ser. Nos. 12/579,905, 12/409,896, 12/466,775, and 12/487,220, also owned by Fellowes, Inc. Other examples of known shredders with thickness sensing features designed to prevent the cutter elements from jamming are U.S. Patent Application Publication Nos. 2009/0025239 A1 (U.S. Pat. No. 7,584,545), 2007/0246582 A2 (U.S. Pat. No. 7,624,938), and 2009/0032629 A1.

No admission is made as to whether the foregoing thickness sensing technologies constitute prior art.

SUMMARY OF THE INVENTION

One aspect of the invention provides a shredder including: a housing having a throat for receiving at least one article to be shredded, the throat having a first side and a second side and the at least one article being received therebetween; and a shredder mechanism received in the housing and including an electrically powered motor and cutter elements. The shredder mechanism enables the at least one article to be shredded to be fed into the cutter elements, and the motor is operable to drive the cutter elements in a shredding direction so that the cutter elements shred the articles fed therein. The shredder also includes a detector for use in controlling operation of the motor having a first contact member on the first side of the throat and a second contact member on the second side of the throat. The first contact member and the second contact member each extend into the throat and are independently moveable relative to one another by a thickness of the at least one article. enable insertion of the at least one article to move the contact members relative to one another by a combined amount.

The combined amount of independent relative movement may correlate to a thickness of the at least one article. The first contact member and the second contact member are actuated in response to the at least one article being inserted into the throat, and the actuation of the first contact member and the second contact member is used to detect the thickness of the at least one article.

In an embodiment, the shredder further includes a controller coupled to the detector which is configured to perform a predetermined operation in response to the combined amount of independent relative movement correlating to a thickness equal to or greater than a predetermined maximum thickness. The predetermined operation may include preventing the motor from driving the cutter elements, illuminating an indicator system, or activating an alarm.

Other objects, features, and advantages of the present invention will become apparent from the following detailed description, the accompanying drawings, and the appended claims.

DETAILED DESCRIPTION OF THE PREFERRED EMBODIMENT(S) OF THE INVENTION

As will become further evident in the description below, the herein described differential jam proof sensor is defined as a sensor that is configured to consider at least two variables to determine thickness of an article being inserted into a throat of a shredder. By measuring article (paper) thickness from both sides of the throat, the shredder system may be considerably less affected and/or completely immune to problems associated with paper wrinkles and flutter. At least one embodiment further simplifies the cost and design of the sensor by using two opposing subminiature micro switches (i.e., binary switches) to provide thickness detection.

Figure 1:
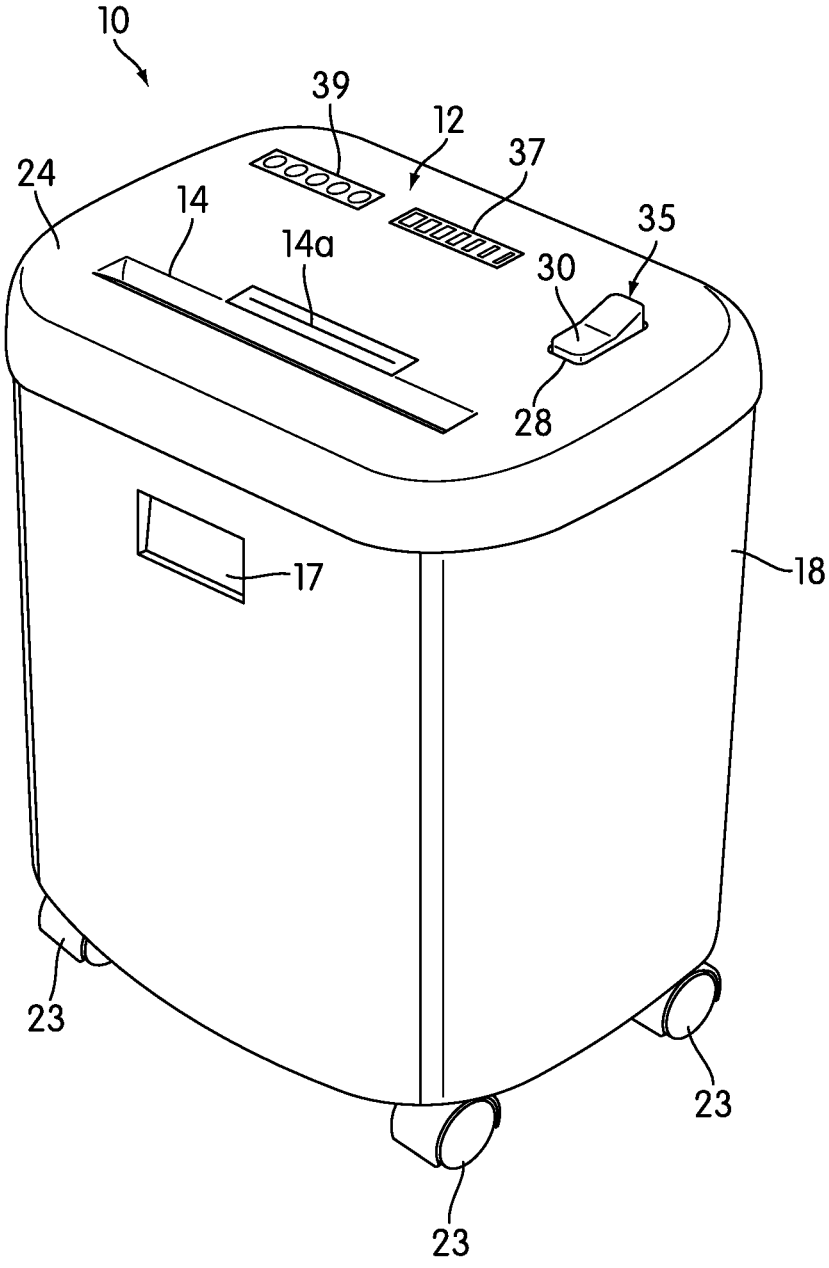
FIG. 1 is a perspective view of a shredder constructed in accordance with an embodiment of the invention.

FIG. 1 is a perspective view of a shredder apparatus 10 constructed in accordance with an embodiment of the present invention. The shredder 10 is designed to destroy or shred articles such as paper, paper products, CDs, DVDs, credit cards, and other objects. The shredder 10 comprises a shredder housing 12 that sits on top of a container 18, for example. The shredder housing 12 comprises at least one input opening 14 on an upper side 24 (or upper wall or top side or top wall) of the housing 12 for receiving materials to be shredded. The input opening 14 extends in a lateral direction, and is also often referred to as a throat. The input opening or throat 14 may extend generally parallel to and above a shredder mechanism 20 (described below). The input opening or throat 14 may be relatively narrow, so as to prevent overly thick items, such as large stacks of documents, from being fed into therein. However, the throat 14 may have any configuration. In some cases, one or more additional or second input openings 14*a* may be provided in shredder housing 12. For example, input opening 14 may be provided to receive paper, paper products, and other items, while a second input opening 14*a* may be provided to receive objects such as CDs and DVDs, credit cards, etc. The upper wall 24 may be molded from a plastic material or any other material. The shredder housing 12 and its upper wall 24 may have any suitable construction or configuration.

Figure 2:
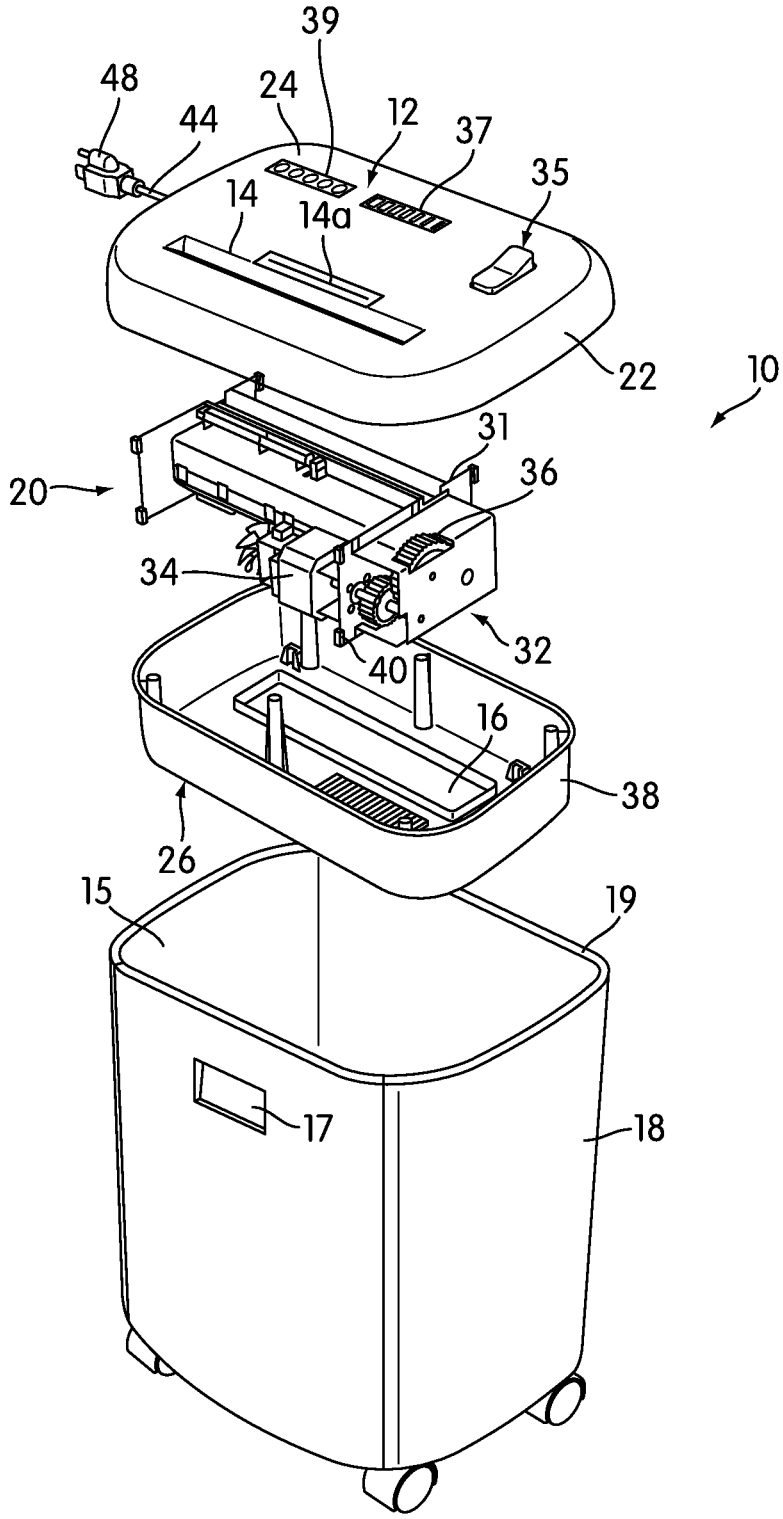
FIG. 2 is an exploded perspective view of the shredder of FIG. 1.

Shredder housing 12 also comprises an output opening 16 on a lower side 26 (or bottom side or bottom wall or underside or bin side), shown in FIG. 2. In an embodiment, shredder housing 12 may include a bottom receptacle 38 with lower side 26 to receive shredder mechanism 20 (along with a motor 34, transmissions, etc.) therein. For example, the bottom receptacle 38 may have a bottom wall forming lower side 26, four side walls and an open top. Bottom receptacle 38 is generally defined as a device or part of housing 12 for at least assisting in securing the shredder mechanism 20 within and/or to the housing 12. The bottom receptacle 38 may be molded from a plastic material or any other material. Bottom receptacle 38 may be affixed to the underside of the upper side 24 or top wall base fasteners, for example. The receptacle 38 has output opening 16 in its bottom side 26 or bottom wall through which shredded particles are discharged. Though lower side 26 is shown as comprising a bottom receptacle 38, the configuration, shape, or design of lower side 26 or receptacle 38 should not be limiting. Generally speaking, the shredder 10 may have any suitable construction or configuration and the illustrated embodiments provided herein are not intended to be limiting in any way. In addition, the term "shredder" or "shredder apparatus," used interchangeably throughout this specification, are not intended to be limited to devices that literally "shred" documents and articles, but instead intended to cover any device that destroys documents and articles in a manner that leaves such documents and articles illegible and/or useless.

As noted, the shredder 10 also comprises a shredder mechanism 20 (shown generally in FIG. 2) in the shredder housing 12. When articles are inserted into the at least one input opening or throat 14, they are directed toward and into shredder mechanism 20. "Shredder mechanism" is a generic structural term to denote a device that destroys articles using at least one cutter element. Destroying may be done in any particular way. For example, the shredder mechanism may include at least one cutter element that is configured to punch a plurality of holes in the document or article in a manner that destroys the document or article. Shredder mechanism 20 includes a drive system 32 with at least one motor 34, such as an electrically powered motor, and a plurality of cutter elements 21 (shown in FIG. 7). The drive system 32 may have any number of motors and may include one or more transmissions. In the illustrated embodiment, the cutter elements 21 are generally mounted on a pair of parallel mounting shafts 25 (shown in FIG. 7). The motor 34 operates using electrical power to rotatably drive first and second rotatable shafts 25 of the shredder mechanism 20 and their corresponding cutter elements 21 through a conventional transmission 36 so that the cutter elements 21 shred or destroy materials or articles fed therein via throat 14, and, subsequently, deposit the shredded materials into opening 15 of container 18 via the output opening 16. The operation and construction of such a shredder mechanism 20 are well known and need not be described herein in detail. Generally, any suitable shredder mechanism 20 known in the art or developed hereafter may be used.

The shredder mechanism 20 may also include a sub-frame 31 for mounting the shafts 25, motor 34, and transmission 36 of the drive system 32 and cutter elements 21. In some cases, the subframe 31 may be connected to both an upper side 24 (e.g., on an underside of upper side 24) and a lower side 26 (e.g., on an upper side of receptacle 38) to secure the shredder mechanism 20 within or to the housing 12. For example, one or more connecting portions 40 may be provided to secure or fasten the frame 31 thereto. Generally, devices such as fasteners, screws, or bolts, and nuts may be used to secure the frame 31 to the upper side 24 and lower side 26 of housing 12. Additionally and/or alternatively, shock absorbing elements, vibration absorbing elements, and/or springs may be used when connecting the shredder mechanism 20 and shredder housing 12.

Also, the plurality of cutter elements 21 may be mounted on first and second rotatable shafts 25 in any suitable manner. For example, in an embodiment, the cutter elements 21 are rotated in an interleaving relationship for shredding paper sheets and other articles fed therein. In an embodiment, the cutter elements 21 may be provided in a stacked relationship. The operation and construction of such a shredder mechanism 20 is well known and need not be discussed herein in detail. As such, the at least one input opening or throat 14 is configured to receive materials inserted therein to feed such materials through the shredder mechanism 20 and to deposit or eject the shredded materials through output opening 16.

Shredder housing 12 is configured to be seated above or upon the container 18. The container 18 is formed of molded plastic material or any other material. The container 18 includes a bottom wall, four side walls, and an open top, for example. As shown in FIG. 2, shredder housing 12 may comprise a detachable paper shredder mechanism that sits atop container 18. That is, in an embodiment, the shredder housing 12 may be removed in relation to the container 18 to ease or assist in emptying the container 18 of shredded materials. In an embodiment, shredder housing 12 comprises a lip 22, seat, or other structural arrangement that corresponds in size and shape with a top edge 19 of the container 18. The container 18 receives paper or articles that are shredded by the shredder 10 within its opening 15. More specifically, after inserting materials into input opening 14 for shredding by cutter elements 21, the shredded materials or articles are deposited from the output opening 16 on the lower side 26 of the shredder housing 12 into the opening 15 of container 18. The container 18 may be a waste bin, for example.

In an embodiment, the shredder 10 may comprise roller members 23 in the form of wheels or casters to assist in moving the shredder 10. For example, the container 18 may include wheels on its bottom (e.g., near the corners, as shown in FIG. 1) so that the shredder 10 can be transported from one place to another.

In an embodiment, the container 18 may be positioned in a frame or a freestanding housing (e.g., formed of molded plastic or other material) beneath the shredder housing 12. For example, the frame may be used to support the shredder housing 12 as well as comprise a container receiving space so that the container 18 may be removed therefrom. The frame may include a bottom wall, three side walls, an open front and an open top. The side walls of the frame provide a seat on which the shredder housing 20 is removably mounted. For example, in an embodiment, a container 18 may be provided to slide like a drawer with respect to a frame (e.g., a pull out bin), be hingedly mounted to a frame, or comprise a step or pedal device to assist in pulling or removing it therefrom from a front or side of the frame. Container 18 may comprise an opening, a handle, or a recess 17 to facilitate a user's ability to grasp the bin (or grasp an area approximate to the recess 17), and thus provide an area for the user to easily grasp to separate the container 18 from the shredder housing 12, thereby providing access to shredded materials. The container 18 may be substantially or entirely removed from being in an operative condition with shredder housing 12 in order to empty shredded materials such as chips or strips (i.e., waste or trash) located therein. In an embodiment, the shredder 10 may comprise one or more access openings (not shown), for example, in part of the container or part of the shredder housing, to allow for the deposit of larger articles therein.

Generally the terms "container," "waste bin," and "bin" are defined as devices for receiving shredded materials discharged from the output opening 16 of the shredder mechanism 20, and such terms are used interchangeably throughout this specification. However, such terms should not be limiting. Container 18 and/or frame may have any suitable construction or configuration, and the illustrated embodiment is not limiting.

Typically, the power supply to the shredder 10 will be a standard power cord 44 with a plug 48 on its end that plugs into a standard AC outlet. Also, a control panel may be provided for use with the shredder 10. Generally, the use of a control panel is known in the art. As shown in FIG. 1, a power switch 35 or a plurality of switches may be provided to control operation of the shredder 10. The power switch 35 may be provided on the upper side 24 of the shredder housing 12, for example, or anywhere else on the shredder 10. The upper side 24 may have a switch recess 28 with an opening therethrough. An on/off switch 35 includes a switch module (not shown) mounted to housing 12 underneath the recess 28 by fastening devices, and a manually engageable portion 30 that moves pivotally within recess 28 (i.e., a rocker switch). The switch module has a movable element (not shown) that connects to the manually engageable portion 30 to move the switch module between its states. Movement of the manually engageable portion of switch 35 moves the switch module between states. In the illustrated embodiment shown in FIG. 2, the switch module connects the motor 34 to the power supply. This connection may be direct or indirect, such as via a controller 42 (shown in FIG. 9). The term "controller" is used to define a device or microcontroller having a central processing unit (CPU) and input/output devices that are used to monitor parameters from devices that at operatively coupled to the controller 42. The input/output devices also permit the CPU to communicate and control the devices (e.g., such as one or more sensors) that are operatively coupled to the controller 42. As is generally known in the art, the controller 42 may optionally include any number of storage media such as memory or storage for monitoring or controlling the sensors coupled to the controller.

The controller 42 likewise communicates with the motor 34 of the shredder mechanism 20. When the switch 35 is moved to an on position, the controller 42 can send an electrical signal to the drive of the motor 34 (e.g., contacts in the switch module are closed by movement of the manually engageable portion 30 and the movable element to enable a delivery of electrical power to the motor 34) so that it rotates the cutting elements 21 of the shredder mechanism 20 in a shredding direction, thus enabling paper sheets to be fed in the throat 14 to be shredded. Additionally or alternatively, when the switch 35 is in an on position, the switch 35 may be set to an idle or ready position, which communicates with the control panel. The idle or ready position may correspond to selectively activating the shredder mechanism 20, for example. Such a position may allow the controller 42 to selectively enable the operation of the shredder mechanism 20 based on the detection of the presence or insertion of at least one article (e.g., paper) in the throat 14 by or based on a waste level or bin full sensing device. The switch 35 may also be moved to an off position (e.g., contacts in the switch module are opened to disable the delivery of electric power to the motor 34), which causes the controller 42 to stop operation of the motor 34. Alternatively, the switch may be coupled to a controller, which in turn controls a relay switch, TRIAC, etc., for controlling the flow of electricity to the motor 34.

The switch module contains appropriate contacts for signaling the position of the switch's manually engageable portion. As an option, the switch 35 may also have a reverse position that signals the controller to operate the motor 34 in a reverse manner. This would be done by using a reversible motor and applying a current that is of reverse polarity relative to the on position. The capability to operate the motor 34 in a reversing manner is desirable to move the cutter elements 21 in a reversing direction for clearing jams, for example. To provide each of the noted positions, the switch 35 may be a sliding switch (e.g., sliding laterally), a rotary switch, or a rocker switch. For example, in an off position the manually engageable portion and the movable element could be located generally in the center of the switch recess, and the on and reverse positions would be on opposing lateral sides of the off position. Also, the switch 35 may be of the push switch type that is simply depressed to cycle the controller through a plurality of conditions. Additionally, the controller may determine that throat 14 (e.g., via one or more sensors) is not clear of articles, and, thus, operate the motor 34 in a reverse direction (e.g., for a short period of time) so as to clear any remaining articles (or parts thereof) from the throat 14 of the shredder 10.

Generally, the construction and operation of the switch 35 and controller 42 for controlling the motor are well known and any construction for these may be used. For example, a touch screen switch, membrane switch, or toggle switches are other examples of switches that may be used. The switch need not be mechanical and could be of the electro-sensitive type. Also, the switch need not have distinct positions corresponding to on/off/idle/reverse, and these conditions may be states selected in the controller by the operation of the switch. Likewise, such a switch may be entirely omitted, and the shredder can be started based on insertion of an article to be shredded.

Any of the conditions could also be signaled by lights, on a display screen, or otherwise. For example, in an embodiment, one or more indicators such as indicator 37 or 39 (shown in FIG. 1) may be included to provide a warning signal to the user, such as an audible signal and/or a visual signal. In an embodiment, and as further described later, indicator 37 may comprise a sheet capacity indictor that progressively indicates the thickness of article(s) or document(s) being inserted into the opening 14 so as to prevent overloading and possible jams. In an embodiment, indicator 39 may comprise a number of indicators corresponding to functions of the shredder, such as, but not limited to: overheating, bin open, bin full, paper jam, and flashing indicators (such as when the shredder has stopped or sensed a condition).

Figure 3:
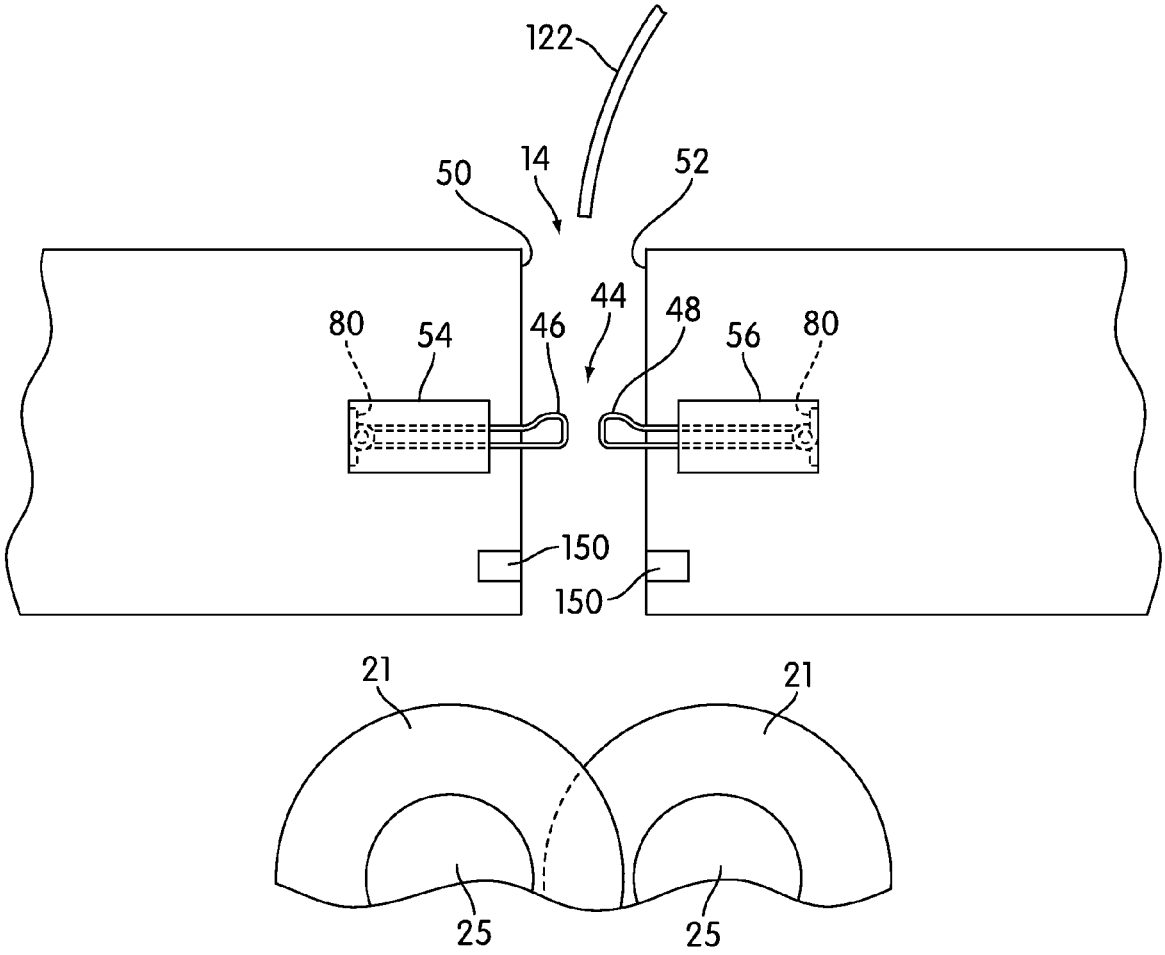
FIG. 3 is an illustration of an embodiment of a detector configured to detect a thickness of an article to be shredded by the shredder in accordance with an embodiment of the invention.

Referring now more specifically to FIG. 3, shredder 10 comprises a detector 44 which is used as a differential jam proof sensor. Detector 44 is configured to detect a thickness of at least one article (e.g., a compact disc, credit card, stack of paper, etc.) received by the throat 14 and is used to control operation of the motor 34. Detector 44 may also be configured to detect a presence of the at least one article in the throat 14. Thus, the detector 44 may detect an article's presence and thickness. Alternatively, a separate detector for detecting the presence of an article in the throat (e.g., such as infrared (IR) sensor 150 shown in FIG. 7) may be utilized. The thickness detection by the detector 44 may determine if an article will be shredded by the cutter elements or if the thickness is over a predetermined capacity and may therefore cause a jam in the cutter elements 21 of the shredder mechanism 20 while shredding, for example.

In the illustrated embodiment, detector 44 comprises a first module 54 with first contact member 46 on a first side 50 of the throat 14, and a second module 56 with a second contact member 48 on a second side 52 of the throat 14. This provides the differential setup of the sensor, i.e., measurements determined by both modules 54 and 56 may be used in determining a thickness of an article. In an embodiment, such as illustrated in FIG. 3, the first contact member 46 and the second contact member 48 are positioned directly opposite one another on the first and second sides 50 and 52 of the throat 14, respectively. The contact members 46 and 48 may be spaced a distance apart so as to allow for insertion of one or more articles into the throat 14 for shredding. The thickness of acceptable article(s) may be determined based on the distance between the contact members 46 and 48. Although the modules and contact members are shown within the throat, it is to be understood that the contact members and/or modules may be provided in an area adjacent, above, or below the throat 14 that can be used to detect an article's thickness when inserted into the throat 14.

The first contact member 46 and the second contact member 48 each extend into the throat 14. The phrase "extend into the throat" refers to the contact members 46, 48 extending into the pathway of the throat (e.g., the area in which an article is to be inserted) and includes areas within the input opening 14, below the input opening 14, and/or above the shredder mechanism 20. Each contact member 46, 48 is configured to move independently relative to one another, and each may be actuated in response to the article being inserted into the throat 14. For example, each contact member 46 and/or 48 may move (e.g., pivot, slide, etc.) from a first position to a second position. For example, the first position may be an initial, default, original position within or adjacent the throat when no article is present in the throat. The insertion of the at least one article into the throat 14 can move either or both of the contact members 46, 48 relative to one another by a combined amount. The combined amount of independent relative movement of the contact members correlates to a thickness of the at least one article. The combined amount need not be equal to the thickness of the article, however. Rather, the thickness of the article may induce the movement of either or both of the contact members and be used to calculate or determine an article's thickness. For example, as noted above, the contact members 46, 48 may be provided a distance from each other in the throat 14. If the distance between the contact members 46 and 48 is approximately 0.5 mm, and both contact members 46, 48 are moved, the thickness of the article may be a combination of the movement of the contact members as well as the distance therebetween. That is, for example, if the contact members move approximately 0.2 mm each (or one moves approximately 0.3 mm and the other moves approximately 0.1 mm), the thickness of the article may be approximately 0.9 mm (after adding in the distance of 0.5 mm between the contact members). Any movement from the first position to a second position assists in obtaining an absolute (paper) thickness of the article. Thus, the actuation of both a first contact member and/or a second contact member may be used to detect the thickness of the at least one article in accordance with an embodiment. In an embodiment, the actuation of both the contact member 46 and the second contact member 48 either determines either that an article thickness is sufficient for shredding (and the shredder mechanism shreds the article) or that an article thickness is too thick (and the shredder mechanism/motor must be prevented from shredding or stopped). In another embodiment, the actuation of at least one contact member 46 or 48 determines that an article thickness is too thick (and the shredder mechanism/motor must be prevented from shredding or stopped). As will be further explained below, the movement of the contact members 46, 48 is provided to their corresponding modules 54, 56 (respectively), and used to control the operation of the shredder mechanism 20.

Each of the first contact member 46 and the second contact member 48 may comprise a spring 80 to assist in the independent relative movement of the contact members 46, 48. Specifically, the springs 80 may assist in moving its associated contact member 46, 48 from a second position to the first (initial, default, original) position, if moved. The springs 80 may be tension springs, for example. Springs 80 bias the first contact member 46 and second contact member 48 towards a first position (towards one another). Each spring 80 is designed to provide similar or substantially identical force to its associated contact member 46 or 48, so that both members 46 and 48 of the detector 44 can move in synch with regard to any action (e.g., due to flapping, flutter, or thickness).

Figure 4:
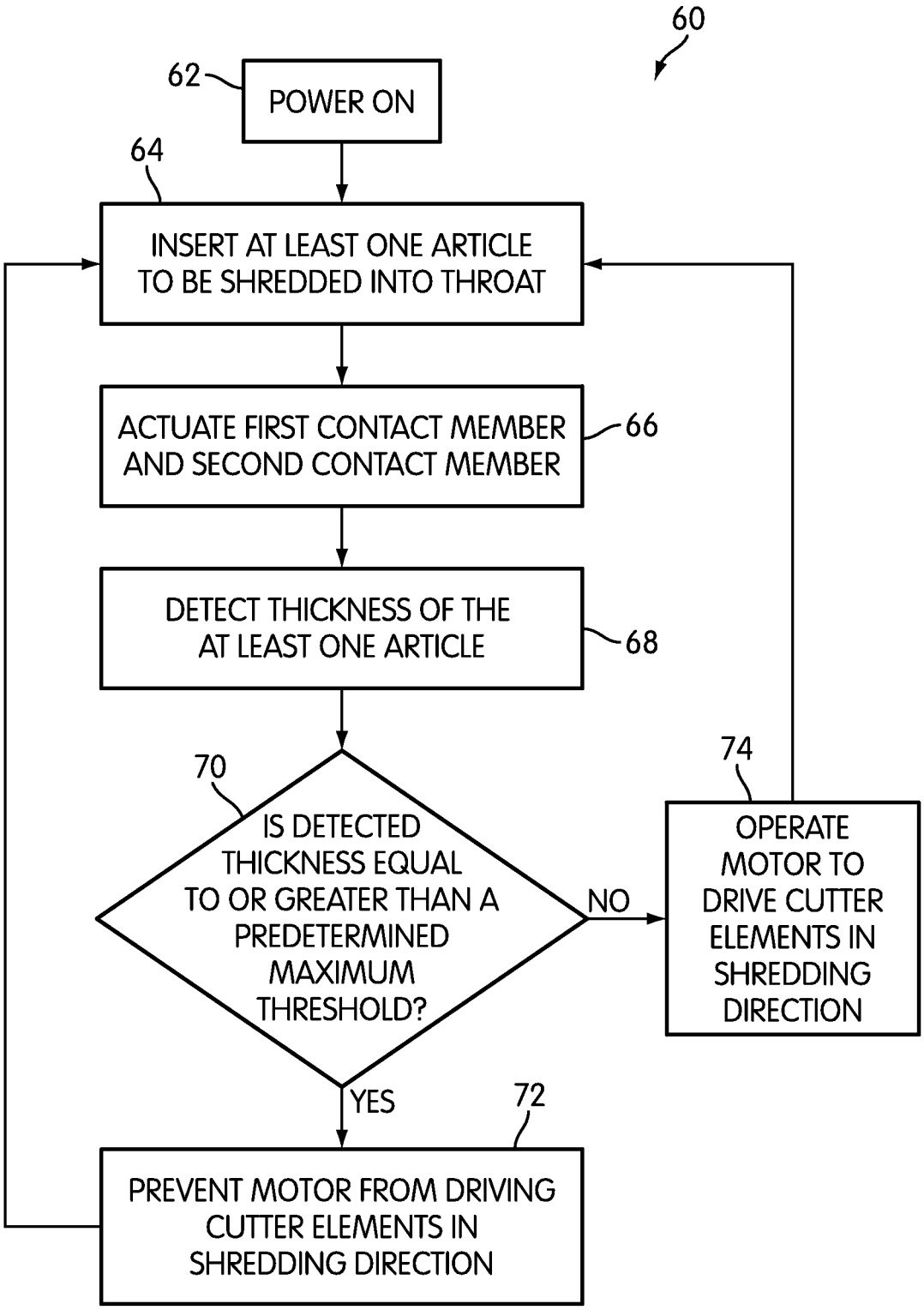
FIG. 4 is a flow diagram of a method for shredding an article in accordance with an embodiment of the invention.

FIG. 4 is a flow diagram of a method 60 for shredding an article using the shredder 10 and detector 44 in accordance with this embodiment. As shown, the power for the shredder may be turned on at 62. At 64, at least one article to be shredded is inserted into the throat. Thereafter, the first contact member (46) and second contact member (48) may be actuated at 66 (for independent movement as a result of the insertion of the at least one article). In some embodiments, the actuation of the contact members can be used to optionally detect the thickness of the at least one article at 68. At 70 it is determined if the detected thickness is equal to or greater than a predetermined maximum threshold. If the detected thickness of the article is equal to or greater than the threshold, the motor of the shredder mechanism 20 is prevented or stopped from driving the cutter elements (21) in the shredding direction, as shown at 72. However, if the detected thickness of the article inserted in the throat is not equal to or greater than the threshold (i.e., the thickness of the article is less than the threshold), the motor is operated (continuously or started) to drive the cutter elements in the shredding direction, as shown at 74. The process 60 may be repeated for each inserted article and/or combined movement of the contact members.

Generally, detector 44 as shown in FIG. 3 does not require much hardware. In an embodiment, the detector 44 may utilize two opposing subminiature microswitches (one switch providing the first contact member 46, the other providing the second contact member 48) to provide paper thickness detection in the shredder 10. For example, in an embodiment, the detector 44 comprises a first binary switch associated with the first contact member 46 and a second binary switch associated with the second contact member 48. The first binary switch is configured to be switched from a first state to a second state in response to the first contact member 46 being moved a first predetermined amount (e.g., via moving from a first position to a second position). The second switch is configured to be switched from a first state to a second state in response to the second contact member 48 being moved a second predetermined amount (e.g., via moving from a first position to a second position). The combined first and second predetermined amounts may correspond to a predetermined maximum thickness. If the combined amount of independent relative movement switches both switches to a second state, it may be indicated that a thickness of the article is equal to or greater than a predetermined maximum thickness.

Figure 8:
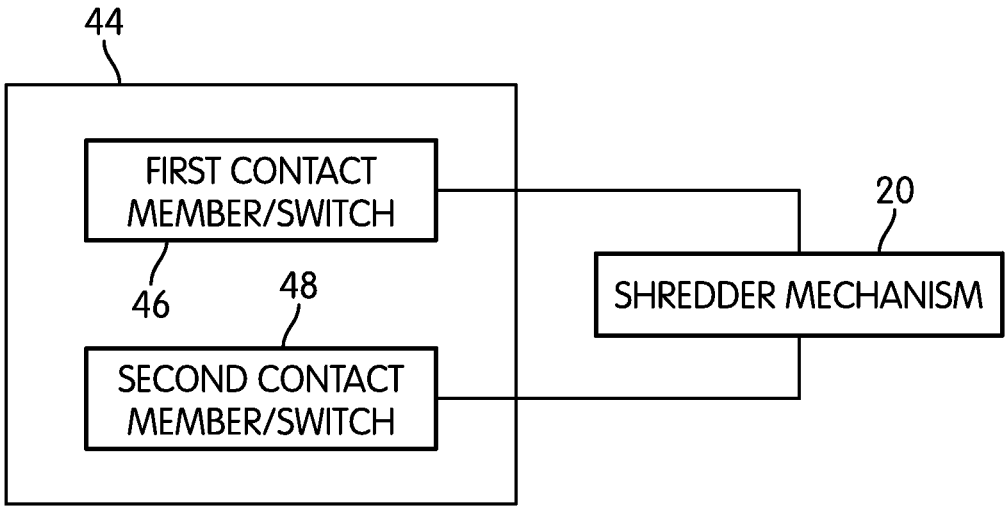
FIG. 8 is a schematic illustration of a first contact member, a second contact member, and shredder mechanism of the shredder in accordance with an embodiment as shown in FIG. 3.

The type of switches or devices, however, should not be limiting. For example, in an embodiment, any size snap action switch can be used. Using microswitches assists in providing automatic control of the shredder mechanism 20, as both switches are binary. That is, the microswitches will provide a "go" (i.e., shred) or "no go" (i.e., no shred) command. FIG. 8 shows a schematic illustration of first contact member 46 and second contact member 48 of detector 44 in connection with shredder mechanism 20 (no controller is required). For example, the contact members 46, 48 as shown in FIG. 3 are configured to move (e.g., pivot, slide, etc.) a distance within the throat 14 as an article is inserted therein. Depending on the placement and thickness of the article, for example, the first contact switch may detect that the member 46 is moved a distance (or angle) and the second contact switch may detect that the member 48 is moved a distance (or angle). Thus, the combined amount of movement would be used to determine the thickness of the article being inserted in the throat 14. If the predetermined thickness threshold is set at an amount larger than that, e.g., if both switches associated with members 46, 48 are binary and are moved but not to a second state, then the shredder mechanism 20 would be driven by the motor 34 and the article inserted into the throat 14 would be shredded. However, if the contact members 46 and 48 are determined to move a distance that determines that a thickness of an article is equal to or greater than a predetermined thickness threshold, i.e., if the switches associated with the members 46, 48 are binary and are moved to a second state, then the shredder mechanism 20 will not be driven by the motor 34 (e.g., it will not start rotating cutter elements 21 or it will be stopped from rotating cutter elements 21).

Figure 5:
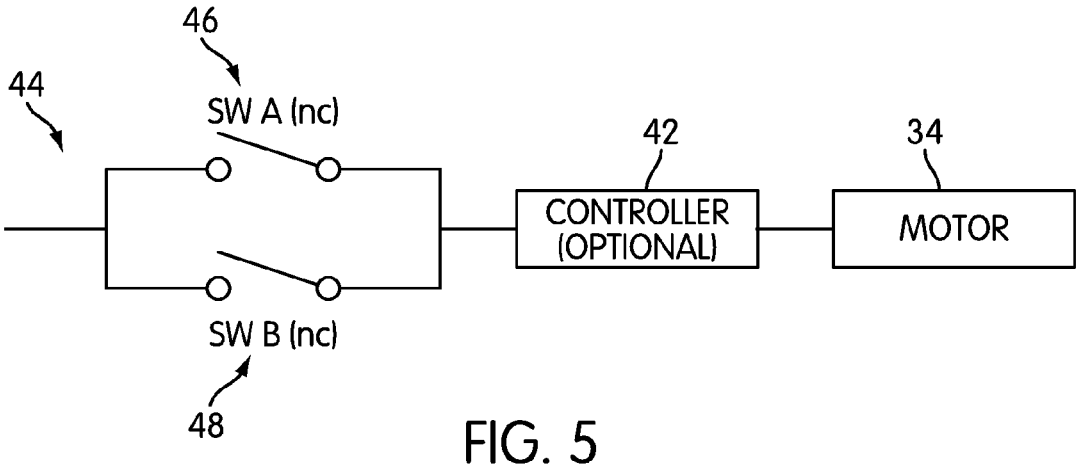
FIGS. 5, 6A and 6B are schematic illustrations of configurations for binary switches in communication with a motor of the shredder mechanism in accordance with an embodiment of the invention.
Figure 6A:
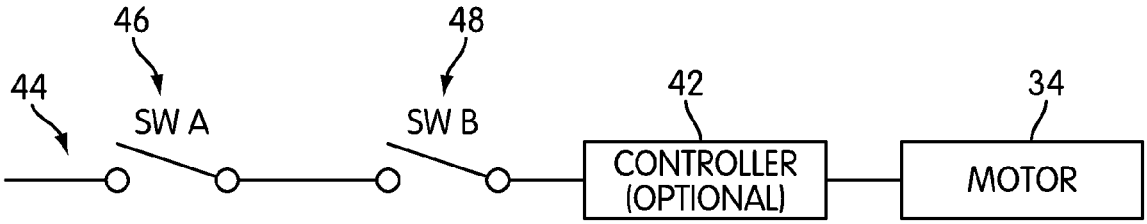
Figure 6B:
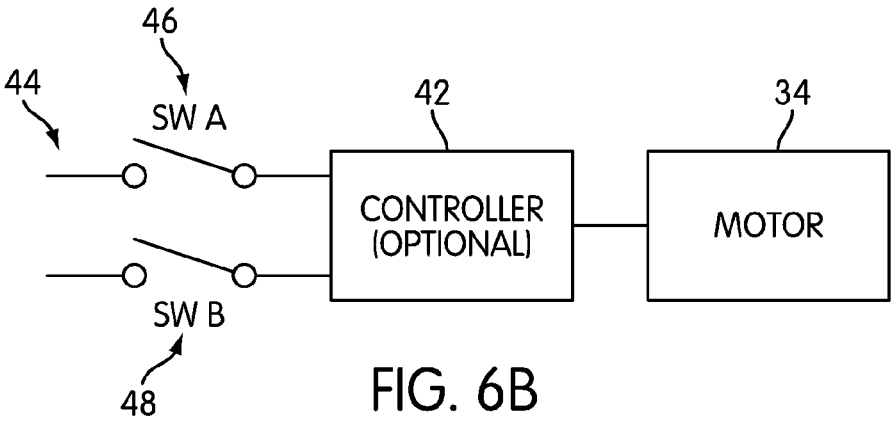

FIGS. 5, 6A, and 6B provide schematic illustrations of three exemplary configurations for using binary switches A and B as detectors 44 for communication with the motor 34 of the shredder mechanism 20, in accordance with an embodiment of the invention. In FIG. 5, switch A and switch B may be wired or otherwise electrically connected in parallel to a motor 34 and normally closed (NC) switches are used. Optionally, but not necessarily, in an embodiment, the switches may be connected to a controller 42. Both switch A and switch B may be actuated (e.g., open) in order to break the circuit and prevent the motor from operating. When both switch A and switch B are actuated, the article for shredding may be too thick (e.g., too much paper is being inserted into the throat). For example, if both switches A and B are actuated for a predetermined period of time, the article is too thick.

The operation of a shredder with the switch configuration of FIG. 5 can work in the following manner: The power for the shredder may be turned on. The first and second switches A and B are not actuated. At least one article to be shredded is inserted into the throat. Thereafter, the first contact member and/or second contact member may be actuated. That is, the position of the first binary switch A and/or the position of the second binary switch B may be altered (via the movement of the first and/or second contact members) (e.g., open). The actuation of the contact members detects the thickness of the at least one article. If only one of the binary switches A or B is actuated (i.e., moved from a first state (NC) to a second state (open)), then the detected thickness of the article inserted in the throat is not equal to or greater than the threshold (i.e., the thickness of the article is less than the threshold), and the motor is operated to drive the cutter elements in the shredding direction. If, however, it is determined that both switches A and B are actuated (i.e., both are opened), this can indicate that the thickness of the article is equal to or greater than a predetermined threshold, and the circuit may thereby prevent the motor 34 of the shredder mechanism 20 from driving the cutter elements in the shredding direction.

In other embodiments, the binary switches A and B are used a sensor devices to determine if a motor should operate (e.g., continue operating or stop operating), as shown in FIGS. 6A and 6B. In FIG. 6A, switch A and switch B may be wired or otherwise electrically connected in series or independently connected to an optional controller 42. Either switch A or switch B may be actuated (from their default position) in order to prevent the motor from operating. For example, if switch A and B in FIG. 6A are NC switches, when either or both switch A and B are open, the switches are actuated. When either of switch A or switch B are actuated, the article for shredding is too thick (e.g., too much paper is being inserted into the throat). Alternatively, both may be actuated, which also indicates that an article is too thick, and the motor is prevented from operating. A shredder with this configuration may act in the following manner: The power for the shredder may be turned on. The first and second switches A and B are closed in their first (default) state. At least one article to be shredded is inserted into the throat. If either first contact member, second contact member, or both, are actuated, and the position of either binary switch A or binary switch B, or both, is altered, it is determined that the circuit is broken and thus the thickness of the article may be equal to or greater than a predetermined threshold. The motor 34 may therefore be prevented from operating and driving the cutter elements.

In another embodiment, as shown in FIG. 6B, switch A and switch B are wired or otherwise electrically connected in parallel to a motor 34 and normally closed (NC) switches are used. Optionally, a controller 42 may also be provided. When shredding an article using a shredder comprising a NC switch configuration as shown in FIG. 6B, the shredder may operate in the following manner: The power for the shredder may be turned on. The first and second switches A and B are closed in their first state. At least one article to be shredded is then inserted into the throat. Thereafter, the first contact member and second contact member may be actuated. The position or state of the first binary switch A and/or the position or state of the second binary switch B may be altered (via the movement of the first and/or second contact members). The actuation of the contact members detects the thickness of the at least one article. It is then determined if either first binary switch A or second binary switch B is open (i.e., moved from a first state to a second state), or both. If "YES," the circuit is broken, and thus the thickness of the article may be equal to or greater than a predetermined threshold and thus the broken circuit may prevent the motor 34 of the shredder mechanism 20 from driving the cutter elements in the shredding direction. However, if both of the first or second switches remain closed, then the detected thickness of the article inserted in the throat is not equal to or greater than the threshold (i.e., the thickness of the article is less than the threshold), and the motor is operated to drive the cutter elements in the shredding direction. The process may be repeated for each article inserted into the throat 14.

Any of the described processes represented by the exemplary configurations of FIGS. 5, 6A or 6B may be repeated for each inserted article. As further described below, in an embodiment, a time delay may be associated with the switches before a determination is made regarding a thickness of the inserted article(s). The time delay may compensate for temporary actuation due to flutter caused by the article(s) being fed into the shredder mechanism 20.

The circuit/switch for any or each of the described configurations may be reset to a home (default) position (e.g., NC) via springs 80 moving the first and second contact members 46, 48 back to an original position (i.e., so that first and second switches A and B are open and moved to a first state).

In an embodiment, switches 46 and 48 comprise standard micro switches with specific actuation parameters. Such parameters may be preset or customized for the shredder. The micro switches chosen for 46 and 48 may be based on the type of switches available on the market. In an embodiment, the switches 46 and 48 are chosen by an amount of actuation force required for activation. For example, switches with a light actuation force (to allow for easy paper entry) may be used.

The use of detector 44 in shredder 10 allows for thickness detection without the need for a microcontroller (as shown in the schematic illustration of FIG. 8), even though in embodiments a controller or microcontroller may be used. Because both modules 54, 56 may utilize contact members/switches 46, 48 that may be binary, the shredder mechanism 20 may be automatically controlled.

Also, having contact members 46 and 48 on either side of the throat 14 allows for contact to be made with article(s) fed into the throat on either or both sides. The thickness of acceptable article(s) may be determined based on the distance between the contact members 46 and 48. Generally, the distance between the contact members can remain the same, allowing for a measure of thickness substantially free from any inadvertent influences, e.g., flutter or flapping (which may be caused as an article is being shredded).

For example, with the two switches, flutter within the given parameters does not stop the operation of the shredder mechanism 20. More specifically, using two binary switches with the contact members of FIG. 3 allows for a determination of the acceptability of an article's thickness at a time of initial paper insertion, because flutter may be an issue as the article is shredded. For example, if the article (paper) flutters towards a right side, the left switch will open, and if the article flutters towards a left side, the right switch will open. Thus, should an article flutter, it will not be mistaken for the article's thickness. As such, the detector 44 is substantially immune to paper wrinkles and flutter while a shredding operation is occurring because it allows almost instantaneous paper over capacity detection when using binary switches.

In an embodiment, to compensate for flutter and/or wrinkles that may be present during shredding, one (or more) of the following four basic techniques may be used:

1) Time delay—in an embodiment, a small time delay (e.g., about 150 milliseconds (ms) or about 100 ms) is added to the switch processing logic in order to ignore temporary changes in the switch's position. For example, if an article begins to flutter it may temporarily move or actuate one or more of the switches 46, 48. Such a time delay will instruct the controller 42 to ignore any switch actuation that is shorter than 0.15 seconds (or 0.10 seconds).

2) Independent processing of switches—in an embodiment, each switch A and B may be processed independently from each other to increase the flutter tolerance. For example, for a shredder including an infrared (IR) auto-start sensor 150 (further noted later), if an article or paper is not detected in the throat 14 by the auto-start sensor, triggering any one of the switches A or B will indicate that the article in the throat 14 is over the shredder's thickness capacity for shredding with the shredder mechanism 20, and the controller 42 can instruct the motor 34 not to start. However, if the auto start sensor detected an article or paper and the motor has thus been turned on, both switches A and B must trigger to signal that the article is over capacity.

For example, in an embodiment, a shredder may have a thickness capacity of 8 sheets, i.e., the shredder mechanism 20 will not operate if a thickness greater than 8 sheets (e.g., greater than 0.8 mm, if each sheet is approximately 0.1 mm) is detected. If paper is not detected by the IR auto-start sensor and switch A and/or switch B are triggered when >9 sheets of paper are inserted for shredding, then disable the motor and indicate that the thickness is over capacity (e.g., using alarm or visual device). If paper is detected by the IR sensor and switches A and B are both triggered when >11 sheets of paper are inserted, then stop shredding by disabling the motor and indicate over capacity. The independent processing of the switches A and B in correlation with the auto-start sensor provides a flutter window (in this example, of 3 sheets) before deactivating the motor and shredder mechanism.

3) Third class lever principle—in an embodiment, the actuation force for actuating the switch trigger can be increased while decreasing actuator travel distance (which may be performed simultaneously). This allows articles that are under thickness capacity to easily pass through the throat 14 without having to displace either switch A or B (46 or 48). Documents that are over capacity may encounter significant resistance against first and second contact members 46, 48 and cause just enough displacement to activate both switches.

Figure 10:
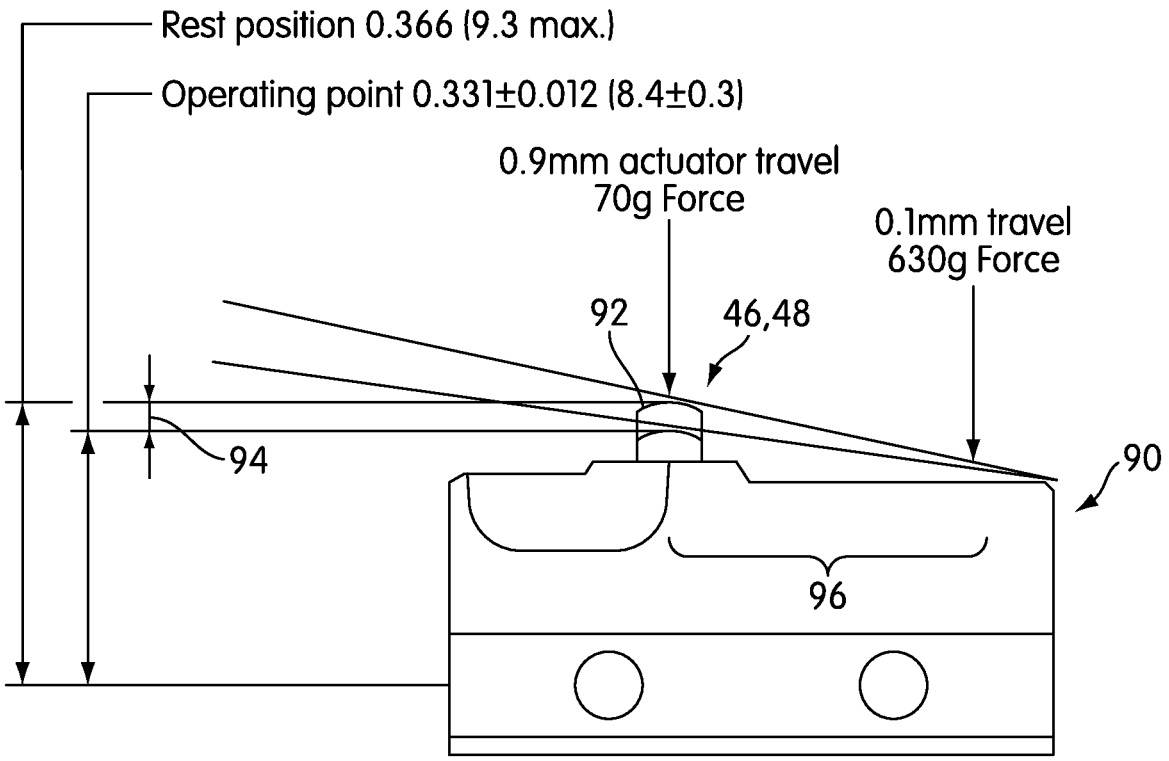
FIG. 10 is an illustration of a relationship between force and traveling distance of an actuation switch in accordance with an embodiment of the invention.

FIG. 10 is an illustration of a relationship between force and traveling distance of an actuation switch 90 in accordance with this embodiment. Actuation switch 90 generally represents a switch as known by those skilled the art. As shown, the actuator 92 may represent first contact member 46 or second contact member 48 (or both). In this illustrated embodiment, the actuator 92 has a rest position of approximately 9.33 mm (maximum) and an operating point of approximately 8.4±0.3 mm. The approximate travel distance 94 of the actuator 92 (i.e., contact members 46, 48) for actuation is approximately 0.9 mm. The approximate actuation force is 70 grams (g) of force.

In an embodiment, based on the third class lever principle, the travel distance of the actuator 92 can be reduced from 0.9 mm (e.g., 9 sheets of paper) to 0.1 mm (e.g., 1 sheet of paper), while increasing a force required to trigger the switch. For example, when the actuator or contact member 46 or 48 is set to travel 0.9 mm (from its resting (or home) position to its operating (or actuation) point), a force of 70 grams is required for actuation. A smaller amount of force may actuate one or both of the switches A and/or B when an article being shredded flutters or is wrinkled during feeding, for example. By using the third-class lever principle and changing the actuator travel (e.g., to 0.1 mm) and increasing the amount of force (from 70 grams to 630 grams) required for actuation, there is more force required to actuate the switches, and thus to control the stopping of the motor and shredder mechanism. Therefore, this principle allows for greater control and compensation with regard to paper wrinkles that are caused by feeding the paper at a severe angle to the cutting mechanism (i.e., such wrinkles will not inadvertent trigger disabling or stopping of the motor/shredder mechanism during a shredding operation). Also, as noted above, the thickness of acceptable article(s) may be determined based on the distance between the contact members 46 and 48. In an embodiment, the rest position and/or operating point settings may be selected or adjusted to set an acceptable thickness for shredding.

It should be noted that any number of travel distances may be selected for actuator 92. For example, a pair of lines provided in FIG. 10 show a decrease in actuator travel distance representing a range of distances to adjust the actuator travel (indicated generally by 96). The travel distance 94 of the actuator 92 may be selected from any number of distances and/or forces for actuation. In this exemplary embodiment, the actuator travel distance and actuation force are inversely proportional.

Figure 11:
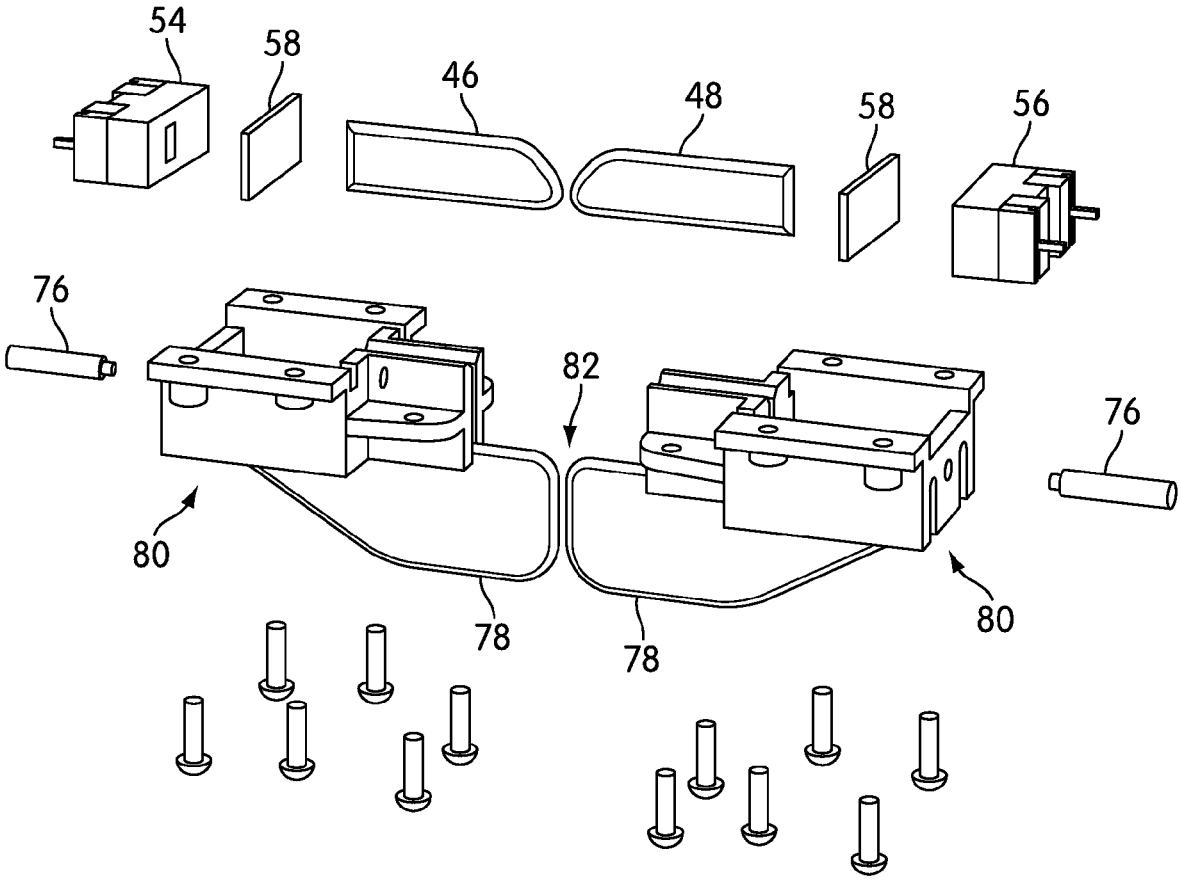
FIG. 11 illustrates an exploded view of exemplary parts of sensor housings including flutter suppression ribs for a shredder in accordance with an embodiment of the invention.

4) Flutter suppression ribs—in an embodiment, a sensor housing 80 (one on each side of the throat 14) in the shredder includes a flutter suppression rib 78, as shown in FIG. 11. Each of the parts are shown here in an exploded view, though it is to be understood that such parts may be assembled with respect to the sensor housings 80. Generally, when assembled on either side of the throat 14, the flutter suppression ribs 78 can create a narrow channel 82 for an article (paper) to pass through below the first and second contact members 46, 48. In an embodiment, the width of the channel 82 may be designed such that it is slightly larger than the rated thickness capacity. For example, a shredder with a thickness limit or capacity of 8 sheets could have a channel width of about 0.88 mm to about 1.2 mm (if the capacity is 0.8 mm).

In an embodiment, flutter suppression ribs 78 may be configured to absorb flutter wave that may be generated by the cutting action of the cutter elements 21 in the shredder mechanism 20. For example, flutter suppression ribs 78 may be formed from resilient material(s). In an embodiment, flutter suppression ribs 78 may be substantially rigid to constrict generated flutter. For example, ribs 78 may be formed from rigid material(s), such as nylon.

Also, although the flutter suppression ribs are shown and described as part of the sensor housings 80, it should be understood that their location should not be limiting. For example, in an embodiment, it is envisioned that the ribs may mounted or provided on either side of the throat 14. In an embodiment, the rubs 78 may be molded into the shredder housing 12.

Alternatively, in yet another embodiment, one or more alternative techniques other than those exemplary embodiments listed above may be used to compensate for paper flutter and/or wrinkles during a shredding operation.

The design and embodiment shown in FIG. 3 further simplifies printed circuit board (PCB) design since the circuit is similar to auto-start detection and does not require a microprocessor (or controller or microcontroller) to calculate paper thickness based on sensor input. It allows for paper thickness measurement without processing delays (which are generally trying to compensate for flutter using software or other calculations). It further simplifies cost and design by using two opposing subminiature micro switches to provide go/no-go paper thickness detection.

Figure 7:
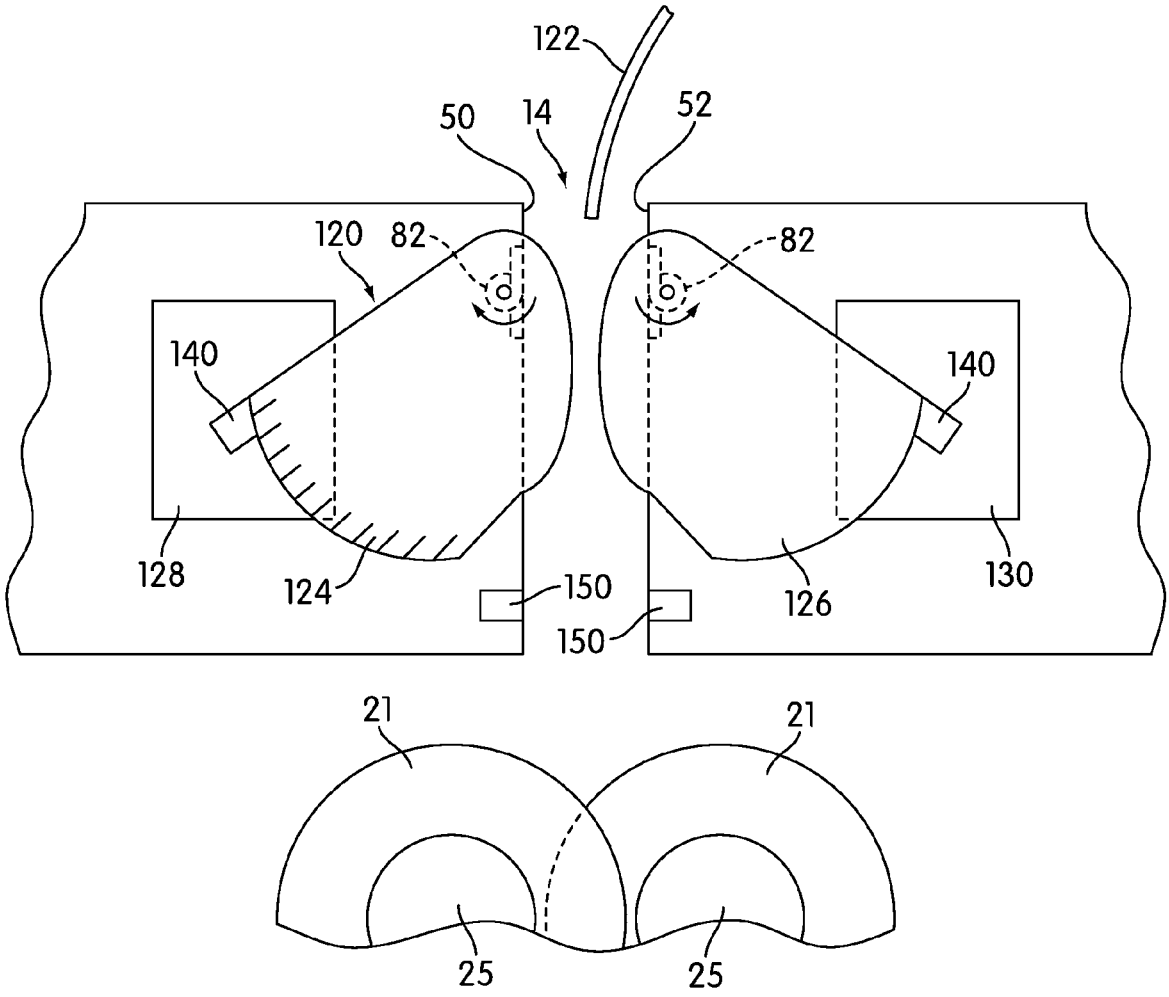
FIG. 7 is a schematic illustration of another embodiment of a detector configured to detect a thickness of an article to be shredded by the shredder.

FIG. 7 shows an alternate embodiment of a differential detector 120 that may be used as a sensor to detect the thickness of an article that is placed in the throat 14 of the shredder 10. Detector 120 comprises a first module 128 with first contact member 124 on a first side 50 of the throat 14, and a second module 130 with a second contact member 126 on a second side 52 of the throat 14. The two modules 128 and 130 allow for measurements determined by both contact members 124 and 126 to be used in determining the thickness of an article.

Like the embodiment of FIG. 3, the first contact member 124 and the second contact member 126 each extend into the throat 14 (either within or adjacent to the throat 14). Each contact member 124, 126 is configured to move independently relative to one another, and each is actuated in response to an article (e.g., article 122) being inserted into the throat 14. First and second contact members 124 and 126 operate in a similar manner as the contact members 46 and 48, described above. That is, their movement from a first position to a second position (if any) is measured/determined, and the measurements are combined together to determine a thickness of an article. Any movement of the contact members 124, 126 is provided to their corresponding modules 128, 130 (respectively), and used to control the operation of the shredder mechanism 20, via a controller.

Each of the first contact member 124 and the second contact member 126 may comprise a spring 82 to assist in the independent relative movement of the contact members 124, 126. Specifically, the springs 82 may assist in moving its associated contact member 124, 126 from a second position to the first (initial, default, original) position, if moved. The springs 82 may be tension springs, for example. Springs 82 bias the first contact member 124 and second contact member 126 towards a first position (towards one another).

This embodiment also includes a controller (schematically shown as controller 42 in FIG. 9) that is coupled to the detector 120. The controller is configured to perform a predetermined operation in response to the combined amount of independent relative movement of the first and second contact members 124, 126 correlating to a thickness that is equal to or greater than a predetermined maximum thickness. In an embodiment, the predetermined operation includes preventing the motor from driving the cutter elements in the shredding direction. In another embodiment, the controller is configured to perform the predetermined operation in response to the combined amount of independent relative movement correlating to a thickness of an article being equal to or greater than the predetermined thickness for a predetermined period of time (e.g., after several seconds).

Furthermore, in this illustrated embodiment, the detector 120 comprises first and second variable displacement sensing devices for measuring movement of each of the first and second contact members 124, 126, respectively. That is, the detector can be configured to detect varying amount of movement of the contact members (as opposed to a simple binary on/off switch). For example, the detection could be continuous, like if a piezoelectric sensor is provided, or could be in increments, like if an optical sensor is provided with markings The variable displacement sensor could be a strain gauge, a piezoelectric sensor, and/or an optical sensor, or any other sensing device that can measure movement of the contact members 124, 126. The measured movement read from the first and second variable displacement sensors may be output to the controller.

In an example embodiment, the detector 120 may include a strain gauge on both first contact member 124 and second contact member 126 which is configured to measure movement of the contact member and communicate the movement to a controller (e.g., controller 42). The detector 120 may include a piezoelectric sensor configured to measure movement of the contact members 124 and 126 and communicate the movement to a controller. In the illustrated embodiment, the contact members 124 and 126 of the detector 120 may each include an optical sensor 140 configured to measure incremental movement of the contact members and communicate the movement to a controller. The optical sensor may include an infrared LED and a dual die infrared receiver configured to detect the direction and amount of the movement. This variable displacement as determined by the sensors may determine if a shredding operation occurs (or not).

As previously mentioned, the detector 120 may also be located above an infrared (IR) sensor 150 that detects the presence of an article. Of course, as noted above, any such sensor or sensing device may be used, that is variable or binary, and detector 120 may have any construction or configuration. Reference may be made to U.S. Patent Application Publication No. 20060219827 A1, Ser. No. 11/444491, filed Jun. 1, 2006 and assigned to the same assignee, which is hereby incorporated by reference in its entirety, for details of alternate detector configurations and designs generally used to detect a thickness of the at least one article received by the throat. The illustrated embodiment is not intended to be limiting in any way. The sensor 150 provides a signal to the controller 42, which in turn is communicated to the motor 34. When the infrared sensor 150 senses that an article is passing through a lower portion of the throat 14, the controller 42 signals the motor 34 to start turning the shafts 25 and cutter elements 21.

In this embodiment, the contact members 124 and 126 of the detector 120 are configured to communicate with the controller 42, although such communication is not entirely necessary. If the combined measurement from the contact members 124, 126 of the detector 120 detects that the thickness of the article that has entered the throat is too thick for the capacity of the shredder mechanism 20 (i.e., above a predetermined maximum thickness threshold), the shredder mechanism 20 may not operate, or may stop, even though the infrared sensor 150 has detected the presence of an article. Of course, this particular configuration is not intended to be limiting in any way.

Figure 9:
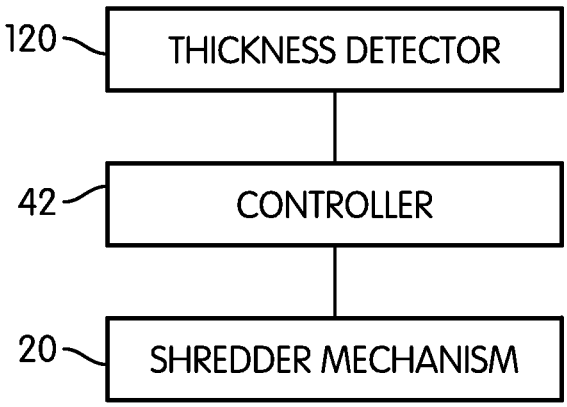
FIG. 9 is a schematic illustration of a detector as shown in FIG. 7, a controller, and other parts of the shredder.

In an embodiment of the invention, the shredder 10 includes a thickness detector 120 to detect overly thick stacks of documents or other articles that could jam the shredder mechanism 20, and communicate such detection to a controller 42, as shown in FIG. 9. The controller 42 is capable of controlling the motor 34 that powers the shredder mechanism 20. The detector 120 in this example is configured to detect at least the thickness of the article(s) 122 received by the throat 14 of the shredder 10, and to relay the thickness of the article (s) 122 to the controller 42. If needed, the controller or control circuit 42 is then able to start, adjust or vary (e.g., increase and decrease) the running operation of the motor based on detected thickness of the articles 122 received from the detector 120.

The controller 42 may include a microcontroller or a timer circuit. In an embodiment, a thickness adjusted motor controller may be used, such as illustrated and described in U.S. patent application Ser. No. 12/579,905 filed Oct. 15, 2009 and/or U.S. patent application Ser. No. 12/348,420 filed Jan. 5, 2009, both of which are hereby incorporated by reference in their entirety. For example, according to an aspect of this disclosure, the controller 42 is configured to vary running operation of the motor continuously responsive to the detector detecting the thickness of the at least one article received by the throat. According to another aspect of the present invention, the controller 42 is configured to vary running operation of the motor based on predefined discrete ranges of thicknesses responsive to the detector detecting the thickness of the at least one article received by the throat. Additionally or alternatively, the controller 42 may be configured to stop the motor 34 when the detector 120 fails to detect at least one article being received by the throat 14 after a predetermined amount of time. Also, the controller 42 may be configured to start a running operation of the motor at at least a predetermined minimum speed responsive to the detector 120 detecting the thickness of the at least one article 122 received by the throat 14 when the thickness is less than a predetermined maximum thickness threshold. The controller 42 may be configured to adjust speed of the motor 34 responsive to the detector 120 detecting the thickness of the at least one article 122 received by the throat 14. For example, the controller may be configured to incrementally increase or incrementally decrease the speed of the motor 34 responsive to the detector 120. The controller 42 may be configured to adjust torque of the motor 34 responsive to the detector 120 detecting the thickness of the at least one article 122 received by the throat 14. The controller 42 may be configured to adjust power usage of the motor 34 responsive to the detector 120 detecting the thickness of the at least one article 122 received by the throat 14. The controller 42 may be configured to prevent the motor 34 from driving the cutter elements and to provide an alarm indication to alert a user responsive to the detector 120 detecting that the thickness of the at least one article 122 is greater than a predetermined maximum thickness threshold.

In some embodiments, the shredder 10 may further comprise an alarm indicator system, and the predetermined operation (e.g., performed by the controller 42) is alerting the user via the alarm indicator system. For example, in an embodiment, upon detecting that the article(s) inserted into the throat 14 exceed the predetermined maximum thickness threshold, the controller 42 may communicate with an indicator such as indicator 37 or 39 (shown in FIG. 1) to provide a warning or alarm signal to the user. This signal may be an audible signal in which the controller 42 sounds an audible alarm and/or a visual signal, wherein the controller 42 may illuminate a visual indicator. Examples of audible signals include, but are not limited to, beeping, buzzing, and/or any other type of signal that will alert the user via sound(s) that the article or document that is about to be shredded is above a predetermined maximum thickness threshold, and may cause the shredder mechanism 20 of the shredder 10 to jam. This gives the user the opportunity to reduce the thickness of the article, or to reconsider forcing the article into the throat 14 and through the shredder, knowing that any such forcing may jam and/or damage the shredder.

In an embodiment, a visual signal, indicating that an article such as article 122 is too thick, may be provided in the form of a red warning light, which may be emitted from an LED, using indicator 37, for example. It is also contemplated that a green light may also be provided to indicate that the shredder 10 is ready to operate. In an embodiment, an indicator 37 may be used which is a progressive indication system that includes a series of indicators in the form of lights to indicate the thickness of the stack of documents or other article relative to the capacity of the shredder is provided. For example, the progressive indication system may include one or more green lights, a plurality of yellow lights, and one or more red light. The green light(s) indicate that the detected thickness of the item (e.g. a single paper, a stack of papers, a compact disc, a credit card, etc.) that has been placed in the throat 14 of the shredder 10 is below a predetermined thickness and well within the capacity of the shredder. The yellow lights provide a progressive indication of the thickness of the item. In an embodiment, a first yellow light, located next to the green light, would be triggered when the detected thickness is at or above a first predetermined thickness, but below a second predetermined thickness that triggers the red light(s). If there is more than one yellow light, each additional yellow light may correspond to thicknesses at or above a corresponding number of predetermined thicknesses between the first and second predetermined thicknesses. The yellow lights may be used to train the user into getting a feel for how many documents should be shredded at one time. The red light(s) indicate that the detected thickness is at or above the second predetermined thickness, which may be the same as the predetermined maximum thickness threshold, thereby warning the user that this thickness has been reached. U.S. Application Publication No. 20090090797 A1, Ser. No. 11/867,260, filed on Oct. 4, 2007 and assigned to the same assignee (Fellowes, Inc.), illustrates and describes such a progressive system, and is hereby incorporated by reference in its entirety. In another embodiment, the indicator(s) comprise one or more alphanumeric indicators (i.e., letters, numbers, etc.).

In an embodiment, the indicators may be provided on a display device such as an LCD screen or other device. In another embodiment, the indicator(s) are configured to display a number of sheets present in the throat 14 of the shredder.

Similarly, the aforementioned indicators of the progressive indicator system may be in the form of audible signals, rather than visual signals or lights. For example, like the yellow lights described above, audible signals may be used to provide a progressive indication of the thickness of the item. Also, in an embodiment, the visual and audible signals may be used together in a single device. Also, other ways of indicating progressive thicknesses of the items inserted in the throat 14 may be used, and the illustrations and descriptions of indicator 37 should not be limiting.

In addition to the thickness detector 120 or 44, the shredder 10 may also include a sensor (not shown) for sensing a performance characteristic of the motor 34. This sensor may be a motor temperature sensor to detect the temperature of the motor and/or a motor current sensor to detect the current drawn by the motor. Monitoring such performance characteristics is generally known in the art and therefore is not explained in detail herein. However, it is noted that by monitoring these type of performance characteristics, the predetermined maximum thickness threshold can be altered (e.g., reduced) to reflect any loss in shredder capability over time. If present, the controller 42 may be configured to alter or adjust such thresholds related to thickness based on temperature, flutter, current flow, and/or other known events that may affect the performance of the shredder 10.

All patents and applications mentioned herein, including those in the Related Art section, are hereby incorporated herein by reference in their entirety.

Although the design and embodiment shown in FIG. 7 may use and/or communicate with controller 42, the use of both first contact member 124 and second contact member 126 provides similar benefits and advantages as previously noted with respect to the embodiment of FIG. 3. With the two switches, flutter (which may be caused as an article is being shredded) within the given parameters does not stop the operation of the shredder mechanism 20. More specifically, using variable displacement sensors with the contact members of FIG. 7 allows for a determination of the acceptability of an article's thickness continually during a shredding operation. For example, if the article (paper) flutters towards a right or a left side, the movement of the article will cause the contact members 124, 126 to move relative to the article, thus continuously determining the thickness within the throat. Thus, should an article flutter, it will not be mistaken for the article's thickness. Furthermore, if a user inserts additional article(s) into the throat during shredding, the contact members 124, 126 will continuously adjust according to the thickness of the total amount of articles in the throat (unless a predetermined maximum thickness is reached). As such, the detector 120 is substantially immune to paper wrinkles, flutter, and insertion of additional articles while a shredding operation is occurring because it allows almost instantaneous paper over capacity detection when using variable displacement sensors.

Also, the design and embodiment shown in FIG. 7 still further simplifies printed circuit board (PCB) design and the thickness of articles can be calculated easily based on the variable sensor input. It allows for paper thickness measurement without processing delays (which are generally trying to compensate for flutter using software or other calculations). It further simplifies cost and design by using two opposing modules to provide go/no-go paper thickness detection.

While the principles of the invention have been made clear in the illustrative embodiments set forth above, it will be apparent to those skilled in the art that various modifications may be made to the structure, arrangement, proportion, elements, materials, and components used in the practice of the invention.

It will thus be seen that the objects of this invention have been fully and effectively accomplished. It will be realized, however, that the foregoing preferred specific embodiments have been shown and described for the purpose of illustrating the functional and structural principles of this invention and are subject to change without departure from such principles. Therefore, this invention includes all modifications encompassed within the spirit and scope of the following claims.

What is claimed is:

1. A shredder comprising:

a housing having a throat for receiving at least one article to be shredded, the throat having a first side and a second side and the at least one article being received therebetween;

a shredder mechanism received in the housing and including an electrically powered motor and cutter elements, the shredder mechanism enabling the at least one article to be shredded to be fed into the cutter elements and the motor being operable to drive the cutter elements in a shredding direction so that the cutter elements shred the articles fed therein;

a detector for use in controlling operation of the motor comprising a first contact member on the first side of the throat and a second contact member on the second side of the throat;

the first contact member and the second contact member each extending into the throat and being independently moveable relative to one another by a thickness of the at least one article.

2. The shredder according to claim 1, wherein insertion of the at least one article moves the contact members relative to one another by a combined amount, and wherein the combined amount of independent relative movement correlates to the thickness of the at least one article.

3. The shredder according to claim 1, wherein the first contact member and the second contact member are positioned directly opposite one another on the first and second sides of the throat, respectively.

4. The shredder according to claim 1, further comprising:

a controller coupled to the detector and being configured to perform a predetermined operation in response to the combined amount of independent relative movement correlating to a thickness that is equal to or greater than a predetermined maximum thickness.

5. The shredder according to claim 4, wherein the predetermined operation includes preventing the motor from driving the cutter elements in the shredding direction.

6. The shredder according to claim 1, wherein the detector further comprises a first binary switch associated with the first contact member and a second binary switch associated with the second contact member; wherein the first binary switch is configured to be switched from a first state to a second state in response to the first contact member being moved a first predetermined amount, and wherein the second switch is configured to be switched from a first state to a second state in response to the second contact member being moved a second predetermined amount, the combined first and second predetermined amounts correlating to a predetermined maximum thickness.

7. The shredder according to claim 1, wherein the detector further comprises first and second variable displacement sensors for measuring movement of each of the first and second contact members, respectively.

8. The shredder according to claim 7, wherein the measured movement is output to the controller.

9. The shredder according to claim 7, wherein the first and second variable displacement sensors are selected from the group consisting of: a strain gauge, a piezoelectric sensor, and an optical sensor.

10. The shredder according to claim 4, further comprising a progressive indicator system to indicate a detected thickness of the at least one article within a range of thicknesses up to and including the predetermined maximum thickness.

11. The shredder according to claim 10, wherein the progressive indicator system includes a plurality of indicators, and wherein each indicator is associated with a corresponding predetermined thickness of the at least one article within the range.

12. The shredder according to claim 11, wherein the plurality of indicators comprises a plurality of lights.

13. The shredder according to claim 11, wherein the plurality of indicators comprises alphanumeric indicators.

14. The shredder according to claim 4, wherein the controller is configured to perform the predetermined operation in response to the combined amount of independent relative movement correlating to a thickness being equal to or greater than the predetermined thickness for a predetermined period of time.

15. The shredder according to claim 14, further comprising an alarm indicator system, and wherein the predetermined operation is alerting the user via the alarm indicator system.

16. The shredder according to claim 4, further comprising an alarm indicator system, and wherein the predetermined operation is alerting the user via the alarm indicator system.

17. The shredder according to claim 1, wherein each of the first contact member and the second contact member comprise a spring to assist in the independent relative movement of the contact members.

18. The shredder according to claim 6, wherein the operation of the motor is stopped in response to the combined first and second predetermined amounts correlating to a thickness being equal to or greater than the predetermined maximum thickness for a predetermined period of time.

19. The shredder according to claim 18, further comprising an alarm indicator system, and wherein the user is alerted of the predetermined maximum thickness via the alarm indicator system.

* * * * *